US006537426B2

(12) United States Patent
Haunlieb

(10) Patent No.: US 6,537,426 B2
(45) Date of Patent: Mar. 25, 2003

(54) DEWATERING BOX COVER MOUNTING DEVICE

(75) Inventor: Herbert Haunlieb, Loosdorf (AT)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 10/104,800

(22) Filed: Mar. 22, 2002

(65) Prior Publication Data

US 2002/0148588 A1 Oct. 17, 2002

(30) Foreign Application Priority Data

Mar. 29, 2001 (DE) ..... 101 15 422

(51) Int. Cl.[7] ..... D21F 1/52
(52) U.S. Cl. ..... 162/374; 162/272
(58) Field of Search ..... 162/352, 374, 162/272

(56) References Cited

U.S. PATENT DOCUMENTS

| | | | | |
|---|---|---|---|---|
| 3,436,306 A | | 4/1969 | Haberecht et al. | 162/374 |
| 3,520,775 A | * | 7/1970 | Truxa | 162/374 |
| 3,647,620 A | * | 3/1972 | Truxa | 162/352 |
| 3,953,284 A | | 4/1976 | Evälahti | 162/352 |
| 4,140,573 A | * | 2/1979 | Johnson | 162/374 |
| 4,459,176 A | * | 7/1984 | Goodnow | 162/374 |
| 5,262,009 A | * | 11/1993 | Schiel et al. | 162/352 |
| 6,379,503 B1 | | 4/2002 | Jansson | 162/199 |

FOREIGN PATENT DOCUMENTS

| | | | |
|---|---|---|---|
| DE | 2 94 057 C | 9/1916 | |
| DE | 19 34 491 A | 1/1971 | D21F/1/80 |
| GB | 15 59 277 | 1/1980 | D21F/1/52 |

* cited by examiner

*Primary Examiner*—Karen M. Hastings
(74) *Attorney, Agent, or Firm*—Taylor & Aust, P.C.

(57) ABSTRACT

A device for attaching a strip cover on a dewatering box in a paper machine; including at least one connecting element extending transverse to the machine direction, to attach the strip cover to the dewatering box across the entire machine width. Fasteners secure the connecting element on the dewatering box in such a manner that it is adjustable, generally transverse to the machine direction, between a clamping position in which it presses the strip cover tightly against the dewatering box, and a release position in which the strip cover is released. At least one adjusting element is utilized for the adjustment of the connecting element, which is accessible from the operator or drive side of the paper machine.

21 Claims, 3 Drawing Sheets

DEWATERING BOX COVER MOUNTING DEVICE

BACKGROUND OF THE INVENTION

1. Field of the Invention

The present invention relates to a device for attaching a strip cover on a dewatering box in a paper machine.

2. Description of the Related Art

Covers or strip covers, which are utilized in the wet section of a paper or cardboard mill, are connected with the associated dewatering box as follows:

In one method the covers are guided in T-rails or dovetail guides. With this mounting method, there is clearance between the cover and the guide device, so that the cover can be pulled from the guide. This method of attachment has the advantage that the cover can be changed, without having to disassemble the entire dewatering element from the paper machine. A problem with this method is that clearance between the guide and the cover may cause oscillations or vibrations during operation.

In another method the covers are mounted rigidly on the dewatering box, using clamping or screw connections. Connections of this type are located across the entire paper machine width. Since this method doesn't normally offer adequate accessibility, the entire dewatering element must be disassembled in order to change the cover.

What is needed in the art is a mounting device, which offers a rigid connection between the strip cover and the dewatering box and allows the cover to be changed without the need to dismantle the entire dewatering element.

SUMMARY OF THE INVENTION

The present invention provides a mounting device for attaching a strip cover on a dewatering box in a paper machine.

The invention comprises, in one form thereof, at least one connecting element, extending transversely to the machine direction, to attach the strip cover to the dewatering box preferably across the entire machine width. Fasteners secure the connecting element on the dewatering box in such a manner that it is adjustable, generally transversely to the machine direction, between a clamping position in which it presses the strip cover tightly against the dewatering box, and a release position in which the strip cover is released. At least one adjusting element is used for the adjustment of the connecting element, which is accessible from the operator or drive side of the paper machine.

This configuration offers not only a rigid, reliable connection between the strip cover and the dewatering box but, because the connection can be released on the operator and/or drive side, the hitherto dismantling of the entire dewatering element, in order to change a cover, is no longer required.

The connecting element, which is preferably in the embodiment of an angled section, can be located on a side of the dewatering box that extends transverse to the machine direction. The angled section engages the strip cover by a manner in which the strip cover is pressed against the dewatering box. The connecting element is positioned in such a manner that during each respective adjustment, relative to the dewatering box, it is moved in a machine cross-direction, as well as a vertical direction to the surface of the strip cover, facing toward the angled section. Due to the movement component, extending vertically to the strip surface, the strip cover is pressed decisively against the dewatering box by the angled section.

The fasteners, which are preferably in the embodiment of bolts, are anchored in the dewatering box and may extend through the guiding slots, that are located in the connecting element, whereby they are always equipped with a head on the free end.

In a preferred, practical embodiment of the device, in accordance with the present invention, the guiding slots slant, relative to the machine cross-direction. Such slanting guiding slots ensure that an adjustment of the connecting element, in a cross-direction, also always creates a movement component vertical to the surface of the strip cover, which presses the strip cover against the dewatering box.

In addition, the connecting element can be positioned so that, simultaneously with a movement into its clamping position, it is pressed against the relating side of the dewatering box, which extends transverse to the machine direction. This removes any remaining looseness in the machine direction.

In its clamping position, the connecting element rests, free from play, laterally against the dewatering box. The head of a respective fastener can act together with a corresponding angled surface of the connecting element, in order to affect the simultaneous pressing of the connecting element against the appropriate side of the dewatering box that extends transverse to the machine direction.

In a preferred, practical embodiment of the device, in accordance with the current invention, at least one connecting element is located on each of the two sides of the dewatering box, extending transversely to the machine direction.

Basically, a single connecting element, extending essentially across the entire machine width, or several connecting elements extending across sections of the machine width, may be located on any respective side. In accordance with a functional, practical design, two connecting elements are provided on at least one side of the dewatering box that extends transverse to the machine direction. The connecting elements each extend across a section of the machine width and are adjustable from opposite sides of the paper machine. The connecting elements positioned on a respective side of the dewatering box can be of the same length and extend at least across half the machine width.

In certain instances it is useful if the fasteners are detachable. The adjusting element includes an adjusting screw. In principle, the adjusting screw can also be detachable. A washer can be provided between the head of the fastener and the connecting element. This may, for example, consist of a different material than the fastener. Brass or bronze washers, or washers of a material similar to the fastener may be utilized.

A sleeve that rolls on the edge of the appropriate guide slot can be slipped onto the fasteners, which are preferably in the embodiment of bolts. A sliding friction between the connecting element and the fastener is thereby avoided.

An adjusting element is allocated to a respective connecting element and may be located either on one side of the paper machine or, specifically in the instance of a connecting element that extends at least essentially across the entire machine width, on the operator side, as well as on the drive side of the paper machine. If, for example, two connecting elements are provided on a respective side of the dewatering box, it may be practical to adjust one from the operator side and the other from the drive side, by way of corresponding adjusting elements.

In a functional practical embodiment, the adjusting element includes an adjusting screw, located at the dewatering box, which is connected with the connecting element, such that the connecting element is adjustable in both directions by way of the adjusting screw.

The connecting element can be configured such that movement into its clamping position can be accomplished by adjustment toward the outside or adjustment toward the inside. The connection is released in the respective opposite direction. The connecting element can be positively interlocked, for example, through an assembly angle, with the adjusting element that is located in the dewatering box. The adjusting element specifically includes an adjusting screw or a locating screw.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
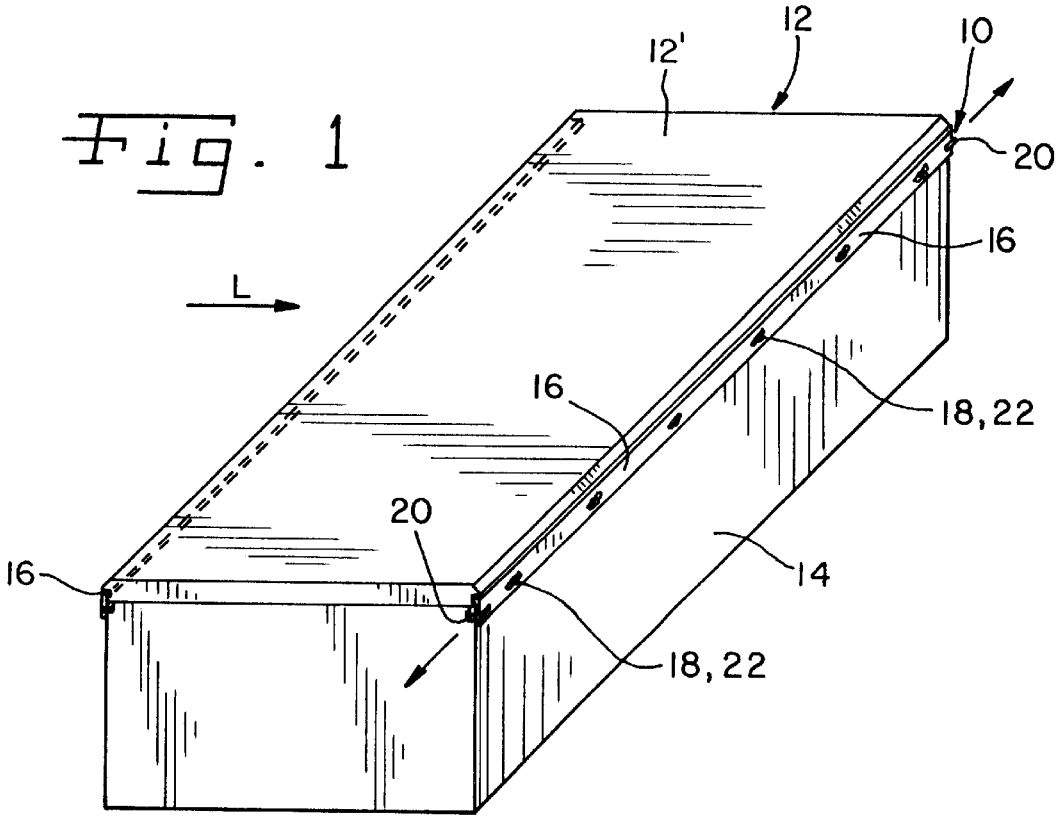
FIG. 1 is a schematic perspective view of a dewatering box with an assigned strip cover that is secured to the dewatering box by a mounting device in accordance with an embodiment of the present invention.
Figure 5:
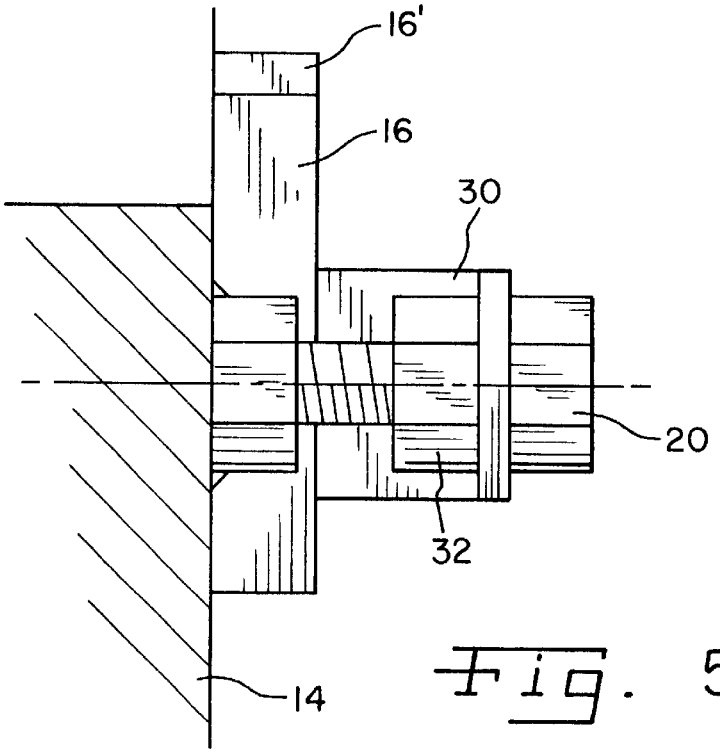
FIG. 5 is a schematic sectional view of an adjusting element, sectioned along line II—II of FIG. 2.

Referring now to the drawings, and more particularly to FIGS. 1 and 5 there is shown a schematic illustration of an embodiment of mounting device 10 for mounting strip cover 12 on dewatering box 14 of a paper machine.

Mounting device 10 includes at least one connecting element 16 extending transversely to the machine direction L or wire direction L, for the machine-wide mounting of strip cover 12 with dewatering box 14.

Connecting element 16 is fastened to dewatering box 14 with fastener 18, providing adjustability of connecting element 16 relative to dewatering box 14, generally transversely to the machine direction L, between a clamping position, in which it presses strip cover 12 tightly against dewatering box 14, and a release position, in which strip cover 12 is released. At least one adjusting element 20, for the adjustment of connecting element 16, which is accessible from the operator or drive side of the paper machine is provided.

Figure 4:
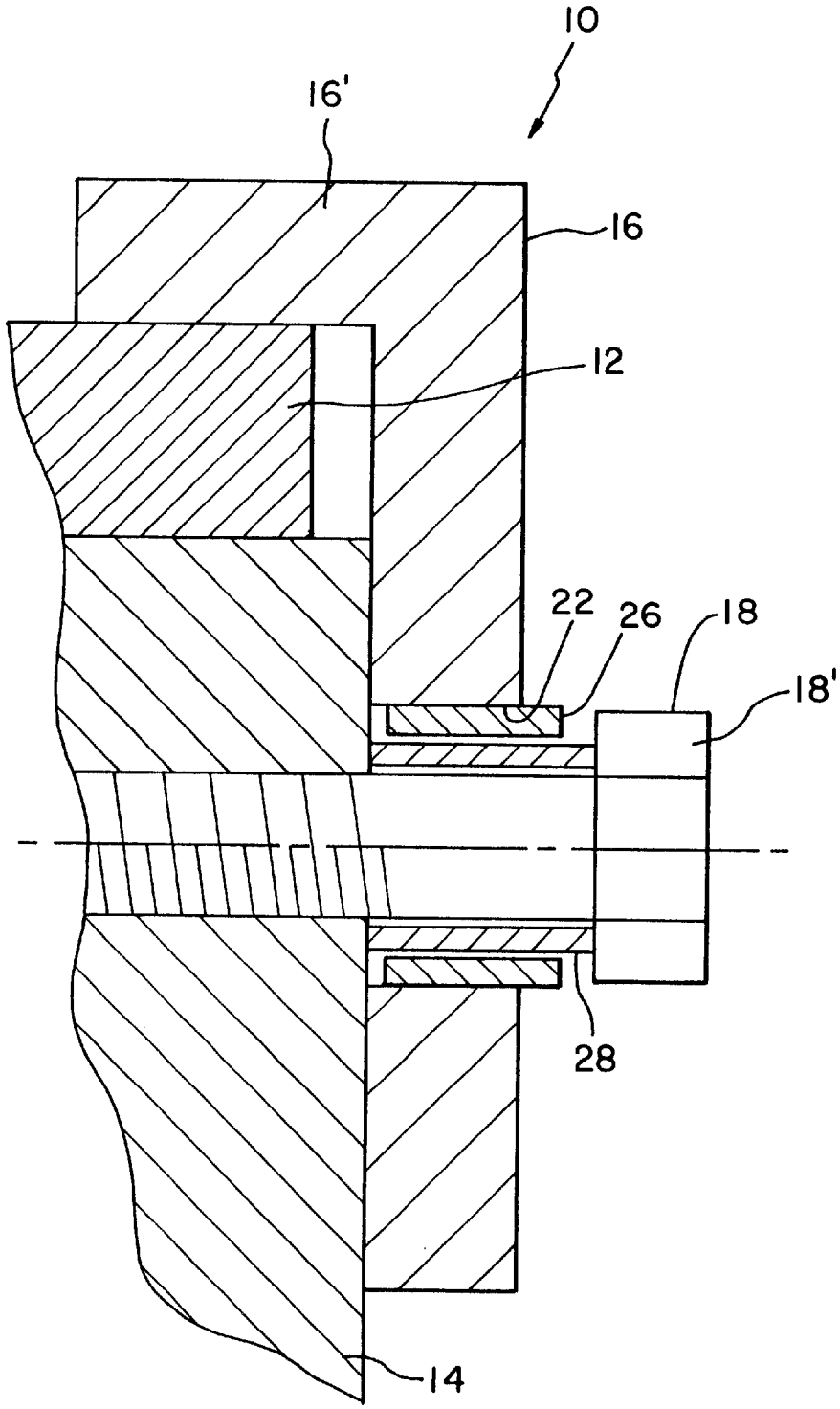
FIG. 4 is a schematic sectional view of the connecting element, sectioned along line I—I of FIG. 2.

Connecting element 16 is in the embodiment of an angle section, as illustrated in FIG. 4, and is located on a side of dewatering box 14 that extends transverse to machine direction L. Connecting element 16 includes angled section 16' that engages with strip cover 12 and causes strip cover 12 to be pressed against dewatering box 14.

Connecting element 16 is positioned on dewatering box 14 in such a manner that during each respective adjustment, relative to dewatering box 14, connecting element 16 is moved in a machine cross-direction, as well as in a direction vertical to the surface of strip cover 12, facing toward angled section 16'.

Fasteners 18, which are preferably in the embodiment of bolts, are anchored in dewatering box 14. Fasteners 18 extend through guiding slots 22 that are located in connecting element 16, fasteners 18, that are preferably in the embodiment of bolts, are preferably equipped with head 18' on their free end. As can be specifically seen in FIG. 2, guiding slots 22 slant relative to the machine cross-direction in order to produce the vertical movement component, relative to surface 12' of strip cover 12, during an adjustment of connecting element 16.

Figure 3:
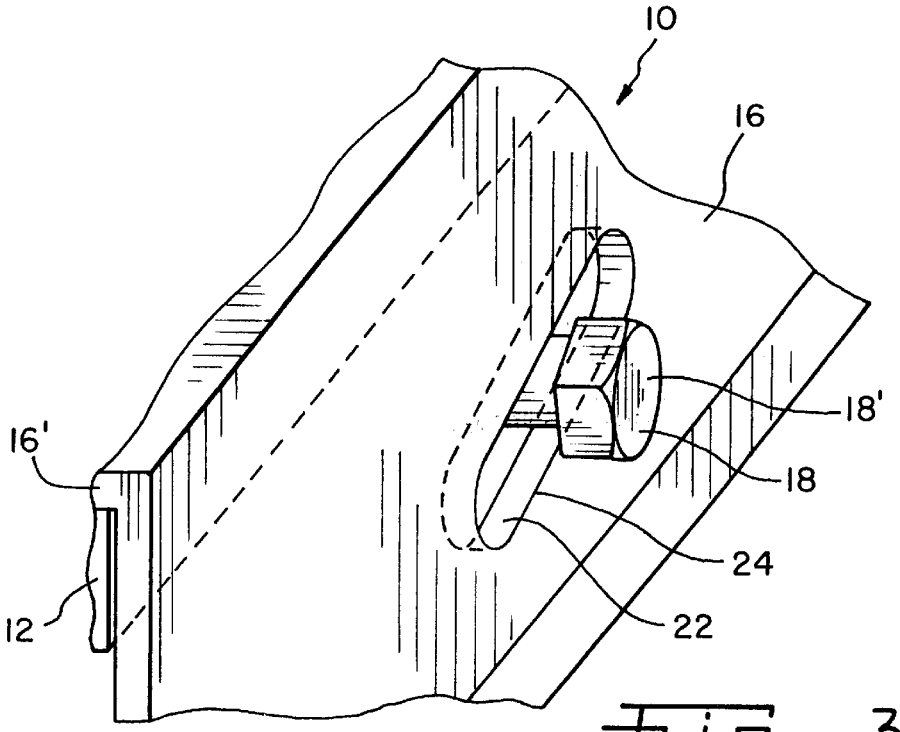
FIG. 3 is an enlarged depiction of a guide slot that is located in the connecting element of the mounting device, shown in FIGS. 1 and 2.

Now, additionally referring to FIG. 3, the respective connecting element 16 is positioned so that simultaneously with its movement into a clamping position, it is pressed against the appropriate side of dewatering box 14, extending transversely to machine direction L. Head 18' of fastening element 18 can act together with a corresponding angled outer surface 24 of connecting element 16. During an adjustment, connecting element 16 is pressed uniformly against the appropriate side of dewatering box 14, extending transversely to machine direction L. At least one connecting element 16 can be located on each of the two sides of dewatering box 14, extending transversely to machine direction L.

As can be seen in FIG. 1, two connecting elements 16, each extending over a section of the machine width, and each being adjustable from opposite edge sides of the paper machine may be provided on at least one side of dewatering box 14 extending transversely to machine direction L. Alternatively, two connecting elements 16 may be provided on a respective side of dewatering box 14, which are of substantially the same length, whereby they each extent across half the machine width.

Fastening elements 18 may or may not be detachable. Adjusting element 20 may specifically be an adjusting screw or a positioning screw. Adjusting element 20 may or may not be detachable.

A washer can be provided between head 18' of fastener 18 and connecting element 16. This may, for example, consist of a different material than fastener 18. Brass or bronze washers, or washers of a similar material may be provided.

Now, additionally referring to FIG. 4, there is shown sleeve 26 that rolls on the edge of guide slot 22 and can be slipped onto fastener 18, which is preferably in the embodiment of a bolt. According to FIG. 4, fastener 18 is also equipped with bushing 28 that is located inside sleeve 26.

Adjusting element 20 is allocated to a respective connecting element 16 and may be located either only on one edge side of the paper machine or, in the instance of connecting element 16, that extends substantially across the entire machine width, may be located on the operator or the drive side of the paper machine. In the example, illustrated in FIG. 1, one adjusting element 20 is allocated to one connecting element 16 on the operator side and one adjusting element 20 is allocated to the other connecting element 16 on the drive side.

Adjusting element 20, which is preferably in the embodiment of an adjusting screw or a locating screw, is positioned at dewatering box 14. Adjusting element 20 can be connected with connecting element 16, in such a manner, that connecting element 16 is adjustable in both directions through one adjusting element 20.

Connecting element 16 can be moved into its clamping position by adjustment toward the outside or by adjustment toward the inside.

Figure 2:
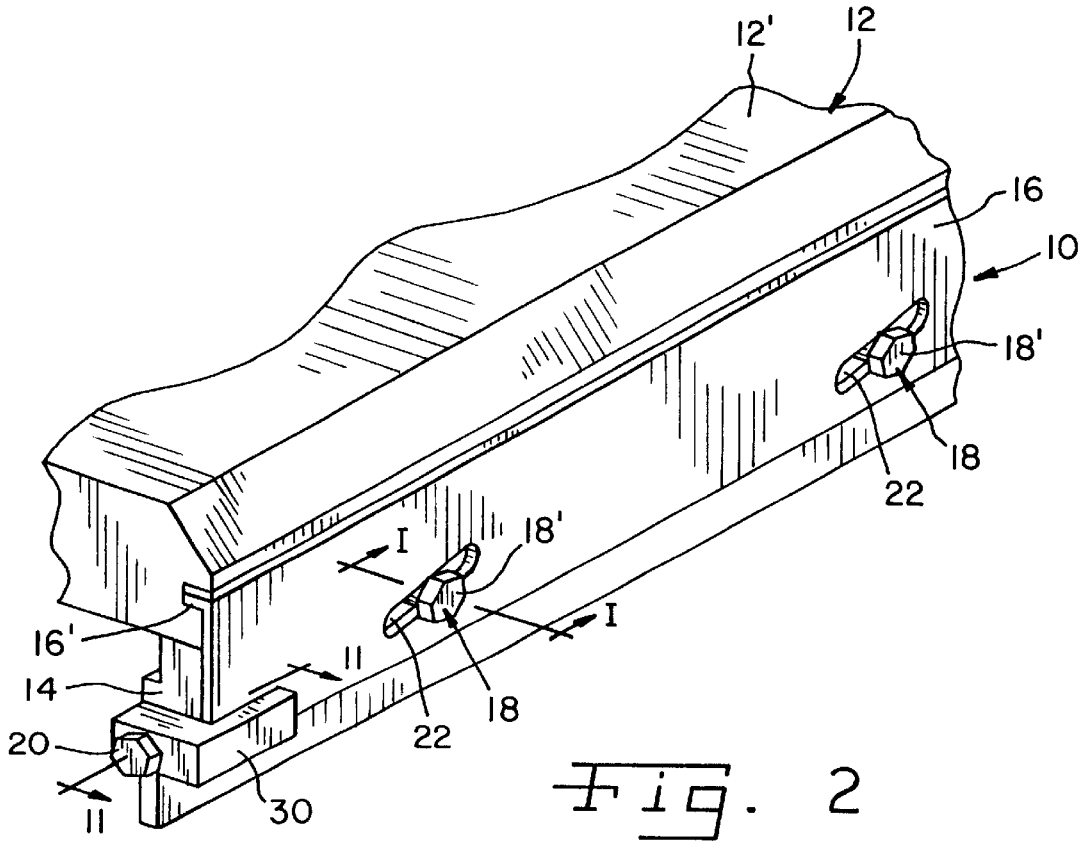
FIG. 2 is a schematic partial view of the mounting device shown in FIG. 1.

As can be seen specifically in FIGS. 2 and 5, connecting element 16 can be positively interlocked, for example, by assembly angle 30 in conjunction with adjusting element 20, which is located in dewatering box 14 and includes an adjusting screw or a locating screw. A lock nut 32 may be allocated to adjusting element 20.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A mounting device in combination with and for attaching a strip cover on a dewatering box in a paper machine, comprising:

at least one connecting element adjustably attaching the strip cover to the dewatering box, said connecting element disposed generally transverse to a machine director and being an angle section positioned to press said strip cover against said dewatering box;

a plurality of fasteners securably connecting said at least one connecting element to said dewatering box; and at least one adjusting element connected to a corresponding said at least one connecting element, said at least one adjusting element being accessible from at least one of an operator side and a drive side of said paper machine, said at least one adjusting element being configured to adjust said at least one connecting element relative to both said strip cover and said dewatering box.

2. The device of claim 1, wherein said at least one connecting element is adjustable to one of a clamping position and a release position.

3. The device of claim 1, wherein said connecting element is configured to move generally transverse to said machine direction and generally perpendicular to a surface of said strip cover.

4. The device of claim 1, wherein said connecting element includes a plurality of guiding slots, said plurality of fasteners includes bolts anchored to said dewatering box, at least one of said bolts extending through a corresponding one of said plurality of guiding slots, said at least one bolt having a head disposed at a free end.

5. The device of claim 4, wherein at least one of said plurality of guiding slots are slanted relative to a machine cross-direction.

6. The device of claim 2, wherein said at least one connecting element is positioned to press against a side of said dewatering box contemporaneously with movement into said clamping position.

7. The device of claim 4, wherein said at least one connecting element includes an angled outer surface, said head co-acting with said angled outer surface to press a corresponding one of said at least one connecting elements against said dewatering box.

8. The device of claim 1, wherein said at least one connecting element includes a first connecting element and a second connecting element, said first connecting element disposed along one side of said dewatering box, said second connecting element disposed along an other side of said dewatering box.

9. The device of claim 1, wherein said at least one connecting element includes a first connecting element and a second connecting element, said first connecting element disposed across a portion of said dewatering box, said second connecting element disposed across an other portion of said dewatering box, said first connecting element being adjustable from one side of said paper machine, said second connecting element being adjustable from an other side of said paper machine.

10. The device of claim 9, wherein said first connecting element and said second connecting element are of approximately the same length and each extend across at least half of the width of said paper machine.

11. The device of claim 1, wherein said plurality of fasteners are detachable from said dewatering box.

12. The device of claim 1, wherein said at least one adjusting element includes an adjusting screw.

13. The device of claim 1, wherein said at least one adjusting element is detachable from said at least one connecting device.

14. The device of claim 4, further comprising at least one washer disposed between at least one said head and a corresponding one of said at least one connecting element.

15. The device of claim 14, wherein said at least one washer is comprised of one of brass and bronze.

16. The device of claim 4, further comprising at least one sleeve disposed on a corresponding one of said plurality of fasteners, said sleeve in rolling engagement with a corresponding one of said plurality of guiding slots.

17. The device of claim 1, wherein said at least one adjusting element is disposed on one of both sides of said paper machine and one side of said paper machine.

18. The device of claim 1, wherein said at least one adjusting element includes an adjusting screw connected to said connecting element, said adjusting screw configured to affect movement of said connecting element in a direction generally traverse to said machine direction and in a direction generally perpendicular to a surface of said strip cover.

19. The device of claim 2, wherein said at least one connecting element is moved into said clamping position by an adjustment toward said operator side of said paper machine.

20. The device of claim 2, wherein said at least one connecting element is moved into said clamping position by an adjustment away from said operator side of said paper machine.

21. A mounting device in combination with and for attaching a strip cover on a dewatering box in a paper machine, comprising:

at least one connecting element adjustably attaching the strip cover to the dewatering box, said connecting element disposed generally transverse to a machine direction;

a plurality of fasteners securably connecting said at least one connecting element to said dewatering box; and at least one adjusting element connected to a corresponding said at least one connecting element, said at least one adjusting element being accessible from at least one of an operator side and a drive side of said paper machine, said at least one adjusting element being configured to adjust said at least one connecting element, said at least one connecting element is positively interlocked by way of an assembly angle with said at least one adjusting element, said at least one adjusting element being located in said dewatering box, said at least one adjusting element including one of an adjusting screw and a locating screw.

* * * * *